United States Patent [19]

Wood

[11] 4,031,564

[45] June 28, 1977

[54] HOCKEY MASK

[76] Inventor: Theodore W. Wood, 17 Ash St., Sherborn, Mass. 01770

[22] Filed: June 24, 1976

[21] Appl. No.: 699,268

[52] U.S. Cl. ..... 2/9

[51] Int. Cl.[2] ..... A41D 13/00

[58] Field of Search ..... 2/9, 10, 426, 427, 441, 2/443, 424, 425

[56] References Cited

UNITED STATES PATENTS

| | | | |
|---|---|---|---|
| 861,170 | 7/1907 | Gamble et al. | 2/9 |
| 1,203,564 | 11/1916 | April | 2/9 |
| 3,259,908 | 7/1966 | Simpson et al. | 2/9 |
| 3,897,597 | 8/1975 | Kasper | 2/9 |
| 3,934,271 | 1/1976 | Rhee | 2/9 X |

FOREIGN PATENTS OR APPLICATIONS

| | | | |
|---|---|---|---|
| 390,685 | 8/1908 | France | 2/9 |

*Primary Examiner*—Werner H. Schroeder
*Assistant Examiner*—Peter Nerbun
*Attorney, Agent, or Firm*—John E. Toupal

[57] ABSTRACT

A hockey mask including a grille work for substantially covering the face of a player wearing a helmet to which it is attached. The grille work defines a plurality of apertures sufficiently small to prevent passage of a hockey stick and a larger sized, elongated, curved opening positioned to extend adjacently to the player's eyes and to substantially encompass the player's field of vision. Covering the opening is a curved, flexible, transparent shield formed from a high impact resistant material. The shield is retained in a state of flex corresponding to its normal curvature by receptacles that receive ends of the shield and engage projections thereon that resist movement of the shield out of the receptacles.

11 Claims, 3 Drawing Figures

HOCKEY MASK

BACKGROUND OF THE INVENTION

This invention relates generally to a protective face mask and, more specifically, to a protective face mask for use by hockey players.

The sport of hockey subjects its participants to a high risk of head and facial injuries. Much of the risk results directly from the implements used during play of a game. Specifically, the hard rubber pucks used in the game are propelled at extremely high velocities and can produce serious injury when striking delicate parts of a body, especially the eyes. In addition, although playing rules prohibit the elevation above shoulder level of the hardwood sticks used to manipulate and propel the pucks, these rules are often violated during the fast and sometimes emotional action that is inherent to the sport. Furthermore, skaters sometimes lose their footing and fall into positions wherein they are susceptible to being struck even by sticks manipulated in accordance with the rules. Consequently, serious bodily injuries are frequently caused by hockey sticks being swung at high velocity.

In relatively recent times hockey helmets have been introduced into hockey play and their use has spread rapidly particularly with younger participants. While significantly reducing the incidence of head injury, the use of helmets did not obviate the facial injury problems. This problem has been addressed more recently by the introduction of protective face masks including both transparent plastic shields and wire cages. Although reducing the likelihood of facial injury, prior protective face shields have exhibited various drawbacks that either limit their effectiveness or render them objectionable to a high percentage of players. For example, cages tend to obscure vision which is extremely important in such a fast moving sport. Similarly, vision is impaired by the tendency of plastic face shields to accumulate condensation (fog-up) during certain environmental conditions. In addition, prior masks have not been fully protective of the face either because they failed to cover all portions thereof or exhibited peripheral openings through which an errant puck or stick could reach even those facial areas directly covered by the shield.

The object of this invention, therefore, is to provide a hockey mask that will effectively prevent facial injury while also being functionally acceptable to one wearing the mask.

SUMMARY OF THE INVENTION

The present invention is a hockey mask including a grille work for substantially covering the face of a player wearing a helmet to which it is attached. The grille work defines a plurality of apertures sufficiently small to prevent passage of a hockey stick and a larger sized, elongated, curved opening positioned to extend adjacently to the player's eyes and to substantially encompass the player's field of vision. Covering the opening is a curved, flexible, transparent shield formed from a high impact resistant material. The shield is retained in a state of flex corresponding to its normal curvature by receptacles that receive ends of the shield and engage projections thereon that resist movement of the shield out of the receptacles. In a preferred embodiment of the invention, the grille work possesses both a horizontal and a vertical curvature that conform to the contour of the player's face and thereby limit the size of peripheral openings through which either errant sticks or pucks could pass. The composite mask fully protects the player's face from injury while the transparent shield provides unobscured vision.

In a featured embodiment of the invention, the projections at the ends of the curved shield are deformations therein produced during manufacture. The projections are latched into engagement with the receptacles by the flexure forces on the shield. Also, the ends of the shield are tabs of reduced size that are joined to the remainder of the shield by shoulder portions that engage the receptacles to limit movement of the shield thereinto. In combination, these structures securely hold the shield in position over the elongated opening in the grille work.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENT

Figure 2:
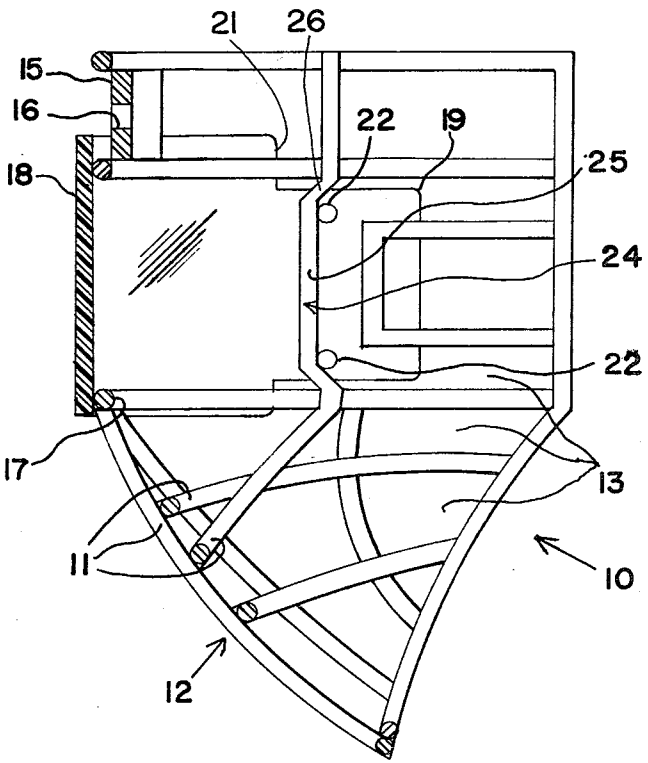
FIG. 2 is a cross-sectional view taken along lines 2—2 of FIG. 1.
Figure 1:
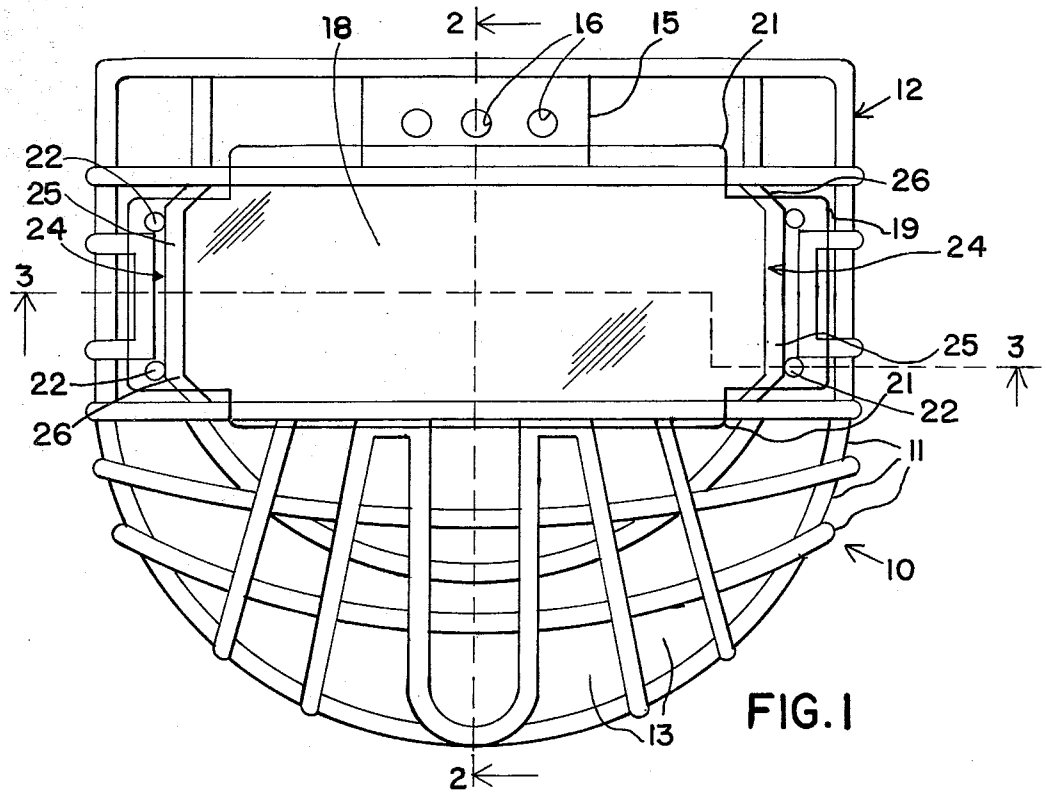
FIG. 1 is a plan view of a hockey mask according to the invention.
Figure 3:
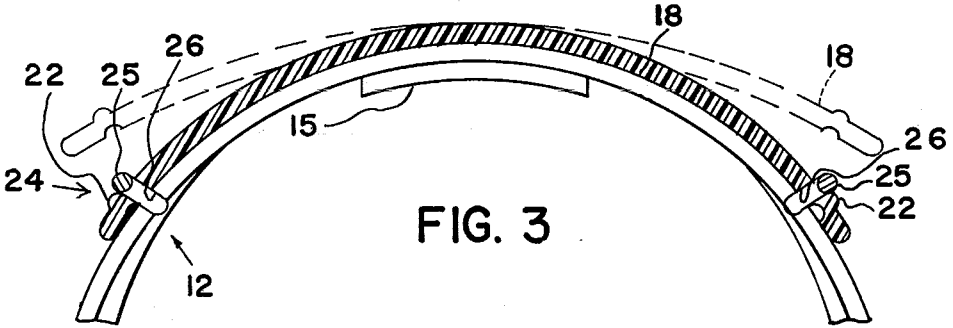
FIG. 3 is a cross-sectional drawing taken along lines 3—3 of FIG. 1.

Referring now to the FIGS. there is shown a hockey mask 10 of the present invention. The mask 10 includes a plurality of wires 11 interconnected into a grillework assembly 12. Preferably metal wires are welded together at intersecting points and then the entire grille work is coated with a suitable plastic. Defined by the wires 11 are a plurality of apertures 13 that permit the free circulation of air through the mask 10 but are of a maximum size that prevents passage of a conventional hockey stick. Preferably, the apertures 13 have a maximum rectilinear spacing between wires of less than 2½ inches.

secured to the grille work 12 is a mounting plate 15 having a plurality of bolt holes 16 for use in attaching the mask to a conventional hockey helmet (not shown). Once so attached, the mask is sized and shaped to cover substantially the entire face of one wearing the helmet. As illustrated in the drawings, the grille work 12 possesses both horizontal curvature (FIG. 2) and vertical curvature (FIG. 3). These curvatures tend to follow the contour of one wearing the mask 10 and thereby limit the openings along its periphery. For this reason the possibility of errantly directly pucks or sticks moving into the region behind the worn mask is diminished.

Also defined by the grille work 12 is a horizontally oriented, curved opening 17 positioned to extend adjacently to the eyes of one wearing the mask and to encompass substantially his entire field of vision. Covering the opening 17 is a similarly curved transparent shield 18 preferably formed of an unbreakable material such as Lexan plastic. At both ends of the shield 18 are tabs 19 formed by shield portions of reduced area. Joining the tabs 19 to the remainder of the shield 18 are shoulder portions 21. Extending outwardly from each of the tabs 19 are a pair of projections 22 produced by deformation of the shield 18. Preferably the deformations 22 are produced by a cold forming operation.

Receiving the tabs 19 are holding receptacles 24 formed by wire loops 25 secured to the grille work 12 at each end of the opening 17. The loops 25 extend outwardly from the grille work 12 so as to permit entry to the tabs 19 and include leg portions 26 that engage the shoulders 21 so as to limit movement of the shield 18 into the receptacles 24. Prior to assembly, the shields 18 are provided, for example by hot forming, with a normal curvature corresponding to the curvature of the opening 17 and illustrated by dotted lines in FIG. 3. However, during assembly, the shield 18 is flexed to increase the extent of this curvature and allow insertion of the tabs 19 into the receptacles 24. The resultant flexure forces bias the tabs 19 into engagement with an underside of the wires 25 forming the receptacles 24. In that position, any tendency of the tabs 19 to move out of the receptacles 24 is resisted by the projections 22 that engage the wire loops 25. Thus, the shield is firmly and securely held in place against the wires 11 forming the opening 17 in the grille work 12.

Obviously, many modifications and variations of the present invention are possible in light of the above teachings. It is to be understood, therefore, that the invention can be practiced otherwise than as specifically described.

What is claimed is:

1. A hockey mask comprising:

a grille work for substantially covering the face of a hockey player, said grille work defining a plurality of apertures sufficiently small to prevent passage of a hockey stick and a larger sized, elongated, curved opening positioned to extend adjacently to the player's eyes and to substantially encompass the player's field of vision;

fastening means for securing said grille work to a hockey helmet;

holding means located at each end of said elongated opening;

a curved, flexible, transparent shield with inner surface edge portions bearing against said grille work so as to cover said opening and having ends retained by said holding means, said shield formed from a high impact resistant material and being retained by said holding means in a state of flex corresponding to its normal curvature; and securing means on said ends of said shield for restraining movement thereof out of said holding means.

2. A hockey mask according to claim 1 wherein said holding means comprise receptacles that retain said ends of said shield and resist the flexure forces tending to straighten said shield.

3. A hockey mask according to claim 2 wherein said securing means comprise projections from the outer surface of said shield, said projections engaging said receptacles to resist movement of said ends of said shield out of said receptacles.

4. A hockey mask according to claim 3 wherein said projections are deformations extending from the front surfaces of said shield.

5. A hockey mask according to claim 1 wherein underside edge portions of said shield are supported by portions of said grille work.

6. A hockey mask according to claim 5 wherein said grille work and said loops are formed by plastic coated metal wires secured together at intersection points by welding.

7. A hockey mask according to claim 6 wherein said apertures are located on all sides of said opening so as to provide free flow of air behind said shield.

8. A hockey mask according to claim 7 wherein all of said apertures have a maximum rectilinear dimension of less than 2½ inches.

9. A hockey mask according to claim 4 wherein said receptacles comprise loops that retain said ends of said shield.

10. A hockey mask according to claim 9 wherein said ends of said shield comprise tab portions of reduced sizes and joined to the remainder of said shield by shoulder portions that engage said loops to limit movement of said shield into said loops.

11. A hockey mask according to claim 10 wherein said grille work possesses both horizontal and vertical curvature so as to conform to the contour of the player's face.

* * * * *